United States Patent [19]

Ingham

[11] 4,267,667

[45] May 19, 1981

[54] BALANCED DOOR

[76] Inventor: Gary G. Ingham, 3534 B Newcastle Rd., Oklahoma City, Okla. 73119

[21] Appl. No.: 71,335

[22] Filed: Aug. 30, 1979

[51] Int. Cl.[3] ..... E05D 15/30

[52] U.S. Cl. ..... 49/252; 49/340; 49/504; 52/291

[58] Field of Search ..... 49/504, 252, 340, 386, 49/253; 52/291

[56] References Cited

U.S. PATENT DOCUMENTS 3,385,003 5/1968 Owen ..... 49/504

3,425,161 2/1969 Catlett et al. ..... 49/253

3,893,273 7/1975 Sailor ..... 52/291

*Primary Examiner*—Kenneth Downey

*Attorney, Agent, or Firm*—Robert K. Rhea

[57] ABSTRACT

An entrance door having its top and bottom rails pivotally connected with arms supported for rotation by a shaft bearing journalled in the door jamb. The door jamb includes a tension member preventing distortion of the door jamb and displacement of the shaft supporting thrust bearing by the mass of the door thus insuring free swinging door movement.

5 Claims, 8 Drawing Figures

FIG. 5
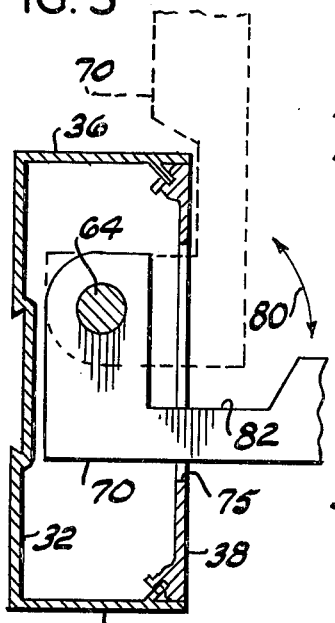
FIG. 2
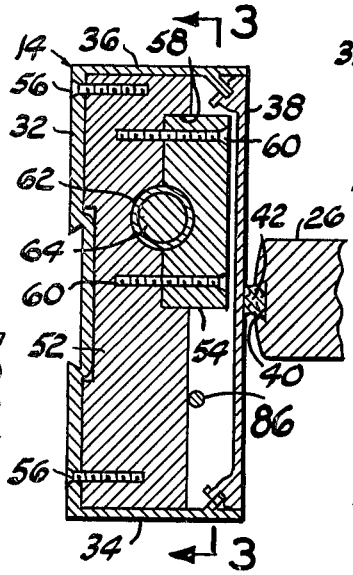
FIG. 1
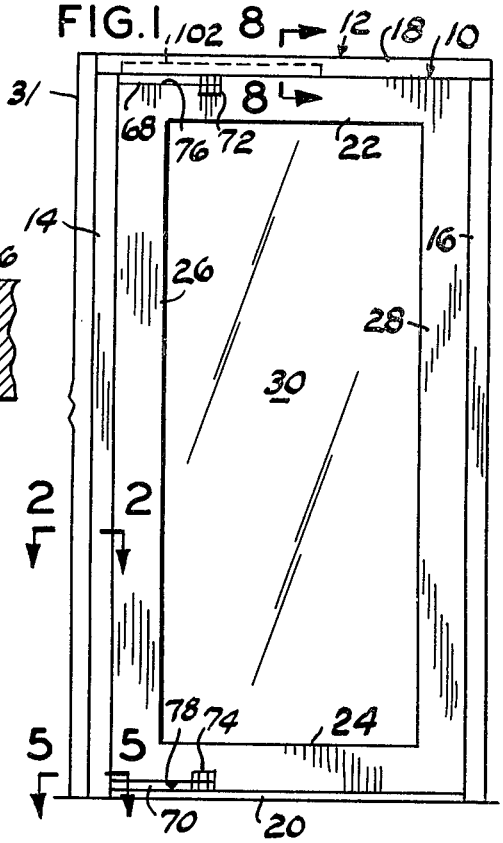
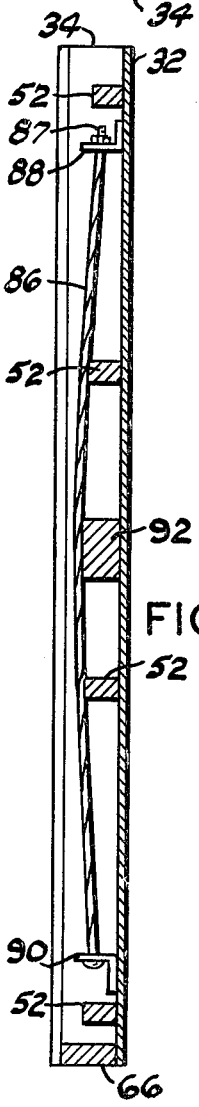
FIG. 4
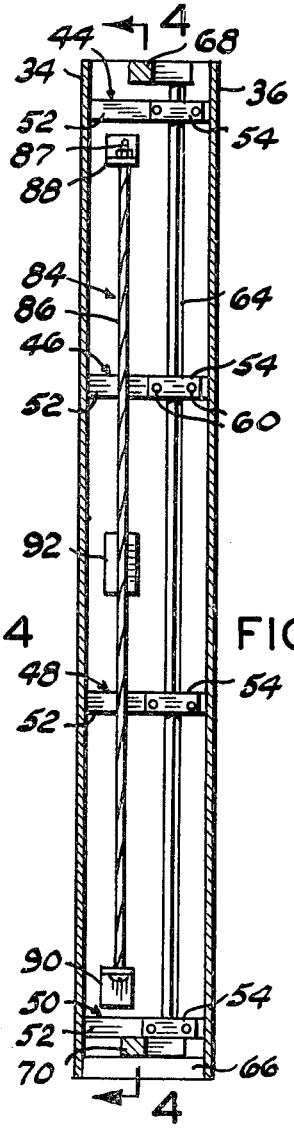
FIG. 3
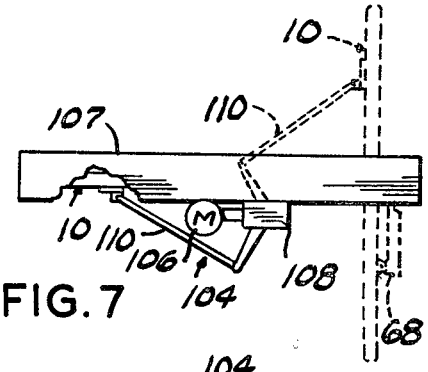
FIG. 7
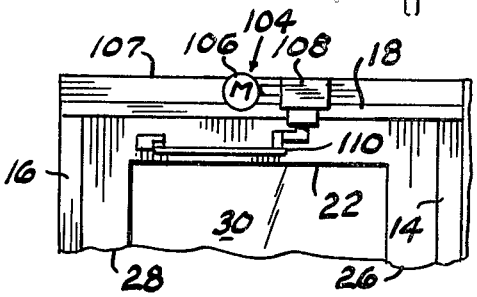
FIG. 6
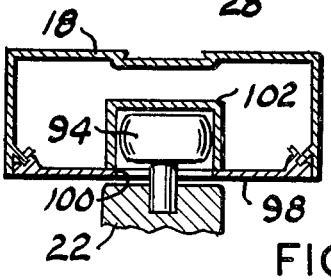
FIG. 8

BALANCED DOOR

BACKGROUND OF THE INVENTION

1. Field of the Invention

The present invention relates to door mountings or supports and more particularly to maintaining a door supporting door jamb plumb for free swinging opening and closing movement of the door.

2. Description of the Prior Art

One-piece glass entryway doors or entrance doors, having a metal frame enclosing a substantially full length glass panel and pivotally connected by arms with a door jamb for swinging movement in one direction, are commonly used. However, the mass of these doors is such that they present a maintenance problem at the depending end of the door jamb connected end of the door by a failure of the bearings or bearing material and a tendency to bow or deform the depending end portion of the supporting door jamb in a direction away from the door. This results in a binding action of the door marginal edges against the members forming the door opening thus failing to maintain the door in a balanced condition for easily pivoting on its mounts in an opening and closing action.

This invention provides a manner of reinforcing the door jamb supporting the door by a tension member connected with the door jamb end portions to maintain it vertical and the door in a balanced condition at all times.

I do not know of any patents disclosing this feature.

SUMMARY OF THE INVENTION

An entryway door is pivotally connected at its top and bottom rails with one end of a pair of arms nested by recesses in one side of the door rails and rigidly connected at their other ends with a shaft extending vertically within a door side jamb. A plurality of bearings within the door jamb support the shaft for rotation about its vertical axis with a thrust bearing supporting the shaft at the depending end of the door jamb. An elongated tension member is connected with the upper and lower end portions of the inner surface of the door jamb opposite the door and entrained in bow string fashion across the several bearings to prevent the mass of the door forcing the depending end portion of the door jamb and thrust bearing out of vertical alignment.

The principal object of this invention is to provide balanced door mounting members including bearings supporting a door mounting shaft within a relatively small in transverse dimension door jamb and a tension member maintaining vertical alignment of the door supporting shaft bearings and the door jamb.

BRIEF DESCRIPTION OF THE DRAWINGS

FIG. 1 is a fragmentary elevational view of a door mounted in an entrance way for swinging movement in one direction;

FIG. 2 is a horizontal sectional view, to a larger scale, taken substantially along the line 2—2 of FIG. 1;

FIG. 3 is a vertical cross sectional view, to a different scale, partially in elevation, taken substantially along the line 3—3 of FIG. 2;

FIG. 4 is a vertical cross sectional view taken substantially along the line 4—4 of FIG. 3;

FIG. 5 is a fragmentary horizontal sectional view taken substantially along the line 5—5 of FIG. 1;

FIG. 6 is a fragmentary elevational view of the top portion of the door opposite the side shown by FIG. 1;

FIG. 7 is a top view of FIG. 6, with parts broken away for clarity, and illustrating, by dotted lines, the open position of the door; and, FIG. 8 is a fragmentary vertical cross sectional view taken substantially along the line 8—8 of FIG. 1.

DESCRIPTION OF THE PREFERRED EMBODIMENT

Like characters of reference designate like parts in those figures of the drawings in which they occur.

In the drawings:

The reference numeral 10 indicates a door mounted for swinging movement in a door frame 12. The door frame 12 comprises door side jambs 14 and 16 interconnected at their upper ends by a head jamb 18 and joined at their depending ends by a threshold 20. The door 10 comprises upper and lower rails 22 and 24 joined by stiles 26 and 28 enclosing a door glass 30. The door jamb 14, abutting a wall 31, is elongated channel-like preferably having a 3" (7.62 cm) to 4½" (11.43 cm) wide bight portion 32 opposite the door stile 26 and 1¾" (4.45 cm) face surface legs 34 and 36 coextensive with the door jamb and projecting toward the door and bridged by a cover plate 38. The length of the cover plate 38 is substantially equal with the height of the door 10. The door stile 26 is provided with a coextensive groove 40 for receiving a strip of resilient fiber material 42 for sealing with the cover plate 38 when the door is in closed position.

A plurality of bearing members, four in the example shown, 44,46, 48 and 50, extend horizontally between the door jamb legs 34 and 36 in vertically spaced-apart relation with two of the bearings 44 and 50 being disposed at the upper and lower end portions of the door jamb. Each of the bearing members 44–50 are characterized by a pair of rectangular bearing block members 52 and 54. The bearing block member 52 is secured to the inner surface of the door jamb bight portion 32 by screws 56. The opposite edge of the bearing block member 52 is recessed, as at 58, for receiving the block member 54 which is secured therein by other screws 60. The two bearing blocks 52 and 54 are vertically drilled, at their juncture, for receiving a sleeve bearing 62 which journals an elongated shaft 64 substantially coextensive with the door jamb 14. The depending end of the shaft 64 is supported by a thrust bearing 66.

A pair of arms 68 and 70 are respectively pivotally connected at one end with a common side of the door rails 22 and 24 in vertical alignment, as at 72 and 74, and project at their other end portions into the door jamb 14 through suitable openings 75 (FIG. 5), only one being shown, formed in the respective end portion of the door jamb cover plate 38 and are secured to the respective upper and lower end portions of the shaft 64. The arms 68 and 70 are nested by horizontal recesses 76 and 78, formed in the upper and lower limit of the respective door rails, when the door is in closed position.

In its opening and closing movement, the door pivots on the vertical axis formed by the arm to door rail pivot positions 72 and 74 while the other end portion of the arms pivot in the direction of the arrow 80 with the shaft 64 about its axis. The shaft connected end of each arm 68 and 70 is provided with a recess 82 permitting the respective arm to be disposed perpendicular to the plane of the wall 31 when the door is in fully open position, as shown by dotted lines (FIGS. 5 and 7).

The door jamb 14 is provided with a tension means 84 comprising an elongated member, such as a cable 86, adjustably secured, as by a threaded bolt 87 secured to one end of the cable, with angle brackets 88 and 90, respectively, connected with the inner surface of the door jamb bight portion 32 at the upper and lower end portions of the door jamb. The cable 86 is entrained tautly across the intermediate bearings 46 and 48 and a spacer block 92 interposed between the cable and the inner surface of the door jamb bight portion 32 intermediate the spacing between the bearings 46 and 48. As best illustrated in FIG. 4, the cable is thus bowed outwardly of the door jamb bight portion 32 beyond the vertical plane defined by the surface of the bearing blocks 52 opposite the bight portion 32 toward the door stile 26 between the respective ends of the door jamb thus tending to pull the respective end portions of the door jamb toward the door and preventing the mass of the door tending to force the thurst bearing 66 and depending end portion of the door jamb 14 toward the wall 31. In the even the door 10 sags, as by binding against the side jamb 16 or threshold 20, the tension on the cable 86 is increased to restore the balanced door condition.

The door is further provided with a guide bearing or roller 94 secured to the upper limit of its top rail 22 and projecting upwardly into the head jamb 18 to form a vertical axis for horizontal pivoting movement of the door. The head jamb closing plate 98 is provided with a slot 100 extending longitudinally substantially one-half the width of the door and further includes an inverted U-shaped channel member 102 forming a guide track or slot for the roller 94 during opening and closing movement of the door.

The door is preferably further provided with an opening and closing mechanism 104, comprising a motor 106 secured to the header 107 above the head jamb 18 and operatively connected with a gear train 108 connected by linkage 110 with the uppermost door rail 22 opposite the position of the arm 68 and on the opposite side of the door. The motor 106 is connected by wiring with a source of electrical energy, neither being shown, and preferably automatically opened and closed in a conventional manner, for example, by a foot pressure operated switch or photoelectric cell, not shown.

Obviously the invention is susceptible to changes or alterations without defeating its practicability. Therefore, I do not wish to be confined to the preferred embodiment shown in the drawings and described herein.

I claim:

1. In an entryway door having stiles and top and bottom rails and having a pair of arms pivotally connected with the respective rails intermediate their ends for horizontal swinging movement of the door about a vertical axis and projecting horizontally into a door side jamb formed by a channel member coextensive with the adjacent door stile and having the legs of the channel projecting from its bight portion toward the door, the improvement comprising:

a shaft disposed within the side jamb coextensive with the door height and rigidly connected at its respective end portions with said arms;

a plurality of vertically spaced bearings secured within said jamb and journalling intermediate portions and respective end portions of said shaft, each said bearing being characterized by a bearing block extending transversely between the side jamb legs and secured to the side jamb bight portion; and, tension means connected with said side jamb for maintaining the latter vertical, said tension means including a pair of angle brackets secured to the surface of the side jamb bight portion facing said door adjacent its respective ends, an elongated flexible member secured to and extending tautly between said angle brackets in overlying relation with respect to at least one said bearing block, and, screw threaded bolt means on at least one end of said flexible member for increasing or decreasing its tension.

2. The combination according to claim 1 and further including:

a cover plate coextensive with the door side jamb channel member and extending transversely between its legs.

3. The combination according to claim 2 and further including:

a spacer interposed between said side jamb bight portion and said flexible member intermediate its ends for disposing an intermediate portion of said flexible member beyond the vertical plane defined by the surface of said bearing blocks facing said door.

4. The combination according to claim 2 or 3 and further including:

a head jamb overlying said door and having a downwardly open guide slot; and, a roller secured to said door top rail and projecting into the guide slot for guiding said door toward and away from said door side jamb during its opening and closing movement.

5. The combination according to claim 2 or 3 in which the transverse dimension of the side door jamb channel member bight portion is not less than 3" (7.62 cm) or greater than $4\frac{1}{2}$" (11.43 cm) and the transverse dimension of said side door jamb legs is $1\frac{3}{4}$" (4.45 cm).

* * * * *